US008210356B1

(12) United States Patent
Krull et al.

(10) Patent No.: US 8,210,356 B1
(45) Date of Patent: Jul. 3, 2012

(54) ORGANIZATIONAL METHODS AND APPARATUS

(76) Inventors: Mark A. Krull, Bend, OR (US); Darrin M. Swagel, St. Louis Park, MN (US)

( * ) Notice: Subject to any disclaimer, the term of this patent is extended or adjusted under 35 U.S.C. 154(b) by 220 days.

(21) Appl. No.: 12/583,129

(22) Filed: Aug. 14, 2009

(51) Int. Cl.
*B65D 85/00* (2006.01)
*B65D 85/28* (2006.01)

(52) U.S. Cl. ..... 206/576; 206/214; 206/509; 220/4.24

(58) Field of Classification Search ..... 206/576, 206/575, 504, 503, 509, 512, 6.1, 214, 745, 206/747; 220/4.24, 4.21, 4.27, 4.26; 312/107, 312/227, 245, 293.1–293.3; 248/490, 339, 248/322, 314–306, 215, 211
See application file for complete search history.

(56) References Cited

U.S. PATENT DOCUMENTS 2,842,264 A * 7/1958 Larson ..... 206/526
4,264,013 A * 4/1981 Vollmer ..... 211/85.2
4,269,381 A * 5/1981 Harms ..... 248/465.1
4,911,392 A * 3/1990 Fast ..... 248/220.31
5,111,362 A * 5/1992 Flamm et al. ..... 361/736
5,332,114 A * 7/1994 Sano et al. ..... 220/4.24
5,433,413 A * 7/1995 Adams ..... 248/205.3
6,182,934 B1 * 2/2001 Kelley ..... 248/304
6,266,942 B1 * 7/2001 McClorey ..... 53/390
6,536,699 B2 * 3/2003 Glass ..... 242/400.1
6,857,519 B2 * 2/2005 Daetweiler et al. ..... 206/6.1
6,926,136 B1 * 8/2005 Lynch-Bass ..... 206/6.1
6,991,118 B2 * 1/2006 Phillips ..... 211/85.3
7,278,537 B2 * 10/2007 Lown et al. ..... 206/45.24
7,658,265 B1 * 2/2010 Dooley ..... 182/129
2005/0103673 A1 * 5/2005 Eichenberger et al. ..... 206/477
2006/0158621 A1 * 7/2006 Kirchhoff ..... 353/119

* cited by examiner

*Primary Examiner* — Steven A. Reynolds

(57) ABSTRACT

A storage device includes a box having a bottom wall, a top wall, a left sidewall, a right sidewall, and an internal wall that divides the box into a first compartment and a relatively larger, second compartment. A roll of tape is rotatably mounted inside the first compartment. First and second bottom drawers occupy a lower portion of the second compartment in side-by-side relationship to one another, and a top drawer rests on top of the bottom drawers. A display panel is rotatably mounted on the box for rotation between a first orientation, blocking access to the second compartment, and a second orientation, allowing access to the second compartment. At least one of a photograph and an erasable writing surface are disposed on the display panel and face forward when the display panel occupies the first orientation. Keyring hooks are secured to a front edge of the bottom wall.

23 Claims, 11 Drawing Sheets

ORGANIZATIONAL METHODS AND APPARATUS

FIELD OF THE INVENTION

The present invention relates to organizational methods and apparatus, and more specifically, to devices that accommodate convenient and efficient storage of various items.

BACKGROUND OF THE INVENTION

Many households have something known as a junk drawer. Many offices and teenager bedrooms have messy desktops. Many garages and shops have cluttered work areas. In other words, clutter is an ongoing battle for many people in various environments. An object of the present invention is to help people reduce their clutter while keeping useful items within reach.

SUMMARY OF THE INVENTION

A preferred embodiment of the present invention may be described in general terms as a storage box. One aspect of the present invention is to form the box by snapping together two identical, injection molded upper and lower box sections, one of which is rotated one hundred eighty degrees relative to the other.

Another aspect of the present invention is to integrate a compartment into the box to retain a roll of tape in a manner that defines both a fixed axis of rotation for the roll of tape and a landing and cutting edge for a distal end of the tape.

Yet another aspect of the present invention is to movably mount a panel on the box to selectively allow access to a forwardly opening compartment defined by the box. A photograph is preferably disposed on one side of the panel, and an erasable writing surface is preferably disposed on an opposite side of the panel. Furthermore, the panel preferably rotates to a release position for removal from the front of the box, and for alternative placement on top of the box.

Still another aspect of the present invention is to store three drawers within a forwardly opening compartment defined by the box. A relatively larger upper drawer rests directly on top of two lower drawers in such a manner that any one of the three drawers may be removed without disturbing the other two drawers.

Yet another aspect of the present invention is to removably mount key hooks on the box. The hooks may be positioned along the lower front edge of the box in one mode of operation, and along the upper side edges of the box in another mode of operation.

Still another aspect of the present invention is to interconnect a plurality of storage boxes in vertical and/or horizontal arrays. Receptacles for receiving the hooks and/or the panel, as described above, may alternatively be used to receive fasteners for interconnecting the boxes.

Various combinations of the foregoing features may be mixed and matched to define a variety of alternative embodiment boxes that fall within the scope of the present invention. Additional aspects and advantages of the present invention will become apparent to those skilled in the art from the more detailed description that follows.

BRIEF DESCRIPTION OF THE FIGURES OF THE DRAWING

With reference to the Figures of the Drawing, wherein like numerals represent like parts and assemblies throughout the several views.

DETAILED DESCRIPTION OF THE PREFERRED EMBODIMENT

Figure 1:
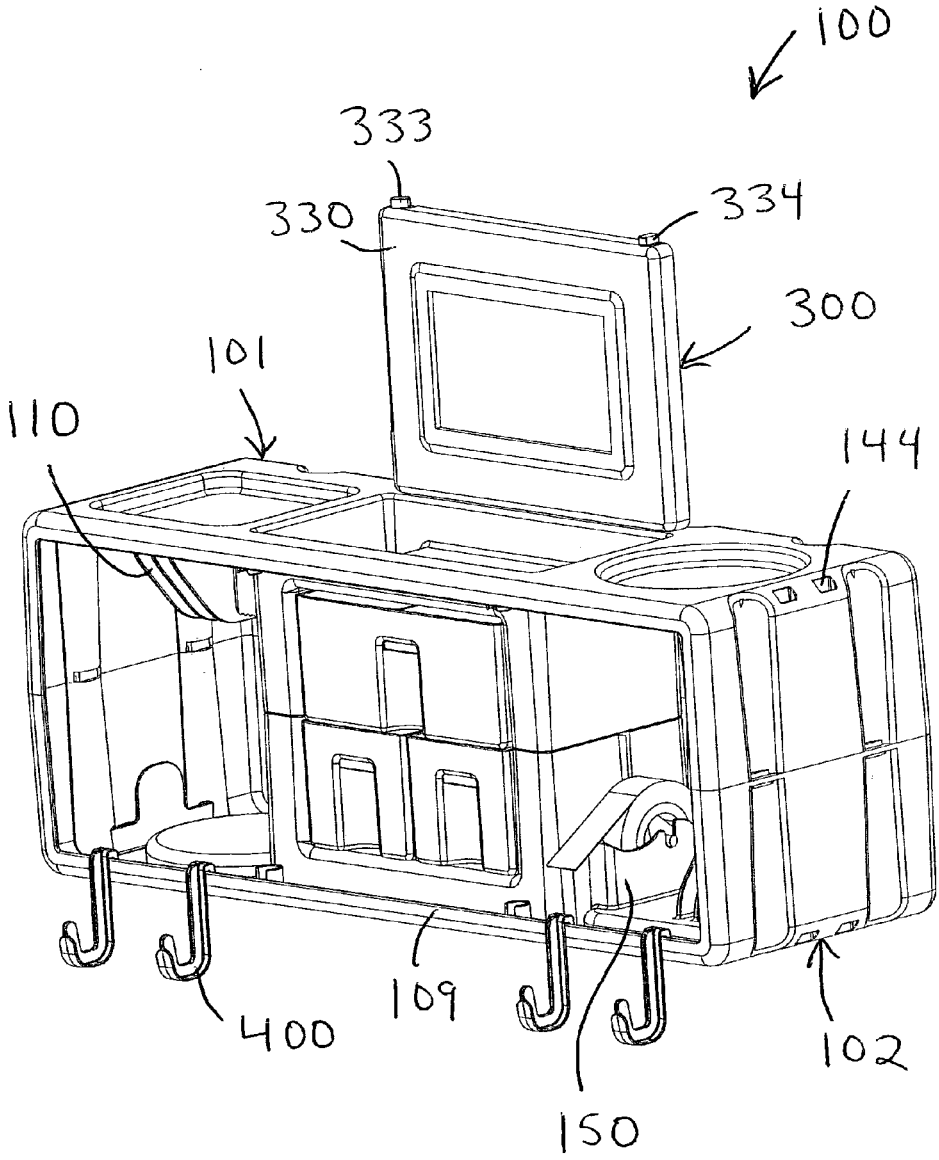
FIG. 1 is a first perspective view of a storage device constructed according to the principles of the present invention, and arranged in a first configuration.

A preferred embodiment storage device constructed according to the principles of the present invention is designated as 100 in FIGS. 1-3 and 7. The storage device 100 may be described in general terms as a box having opposite first and second end walls (or left and right walls), opposite top and bottom walls, and a rear wall. A front wall or lip 109 preferably extends inward from the front edges of the end walls and top and bottom walls. This lip 109 enhances both the structural integrity and the appearance of the box 100. FIG. 4 shows the components of the storage device or box 100 in relative isolation from one another. These components include an upper box section 101 and a lower box section 102; an upper drawer 210 and two lower drawers 220; a frame member 330 and a board 340 that cooperate to define a panel (designated as 300 in FIGS. 1-3 and 7); a plurality of hooks 400; and a conventional tape roll 95.

The two box sections 101 and 102 are preferably injection molded plastic, and are preferably formed using the same mold. In other words, the two sections 101 and 102 are identical to one another in size and configuration. Variations of the box 100 may be made by making the box sections 101 and 102 different colors, and/or by making at least one of the box sections 101 and 102 relatively more transparent than the other. On the preferred embodiment, the lower box section 102 is preferably made of opaque plastic, and the upper box section 101 is preferably made of transparent plastic, allowing relatively more light to reach the interior of the box 100 through the walls of the upper box section 101. As shown in FIG. 4, the upper box section 101 is rotated one hundred eighty degrees relative to the lower box section 102, and the two sections 101 and 102 are interconnected via respective snap fitting tabs 107 and slots 108. Semi-cylindrical columns extend longitudinally at intermittent locations along the back wall and the side walls. These columns accommodate molding of the tabs 107 and the slots 108, and also enhance the structural integrity of the box 100.

Figure 7:
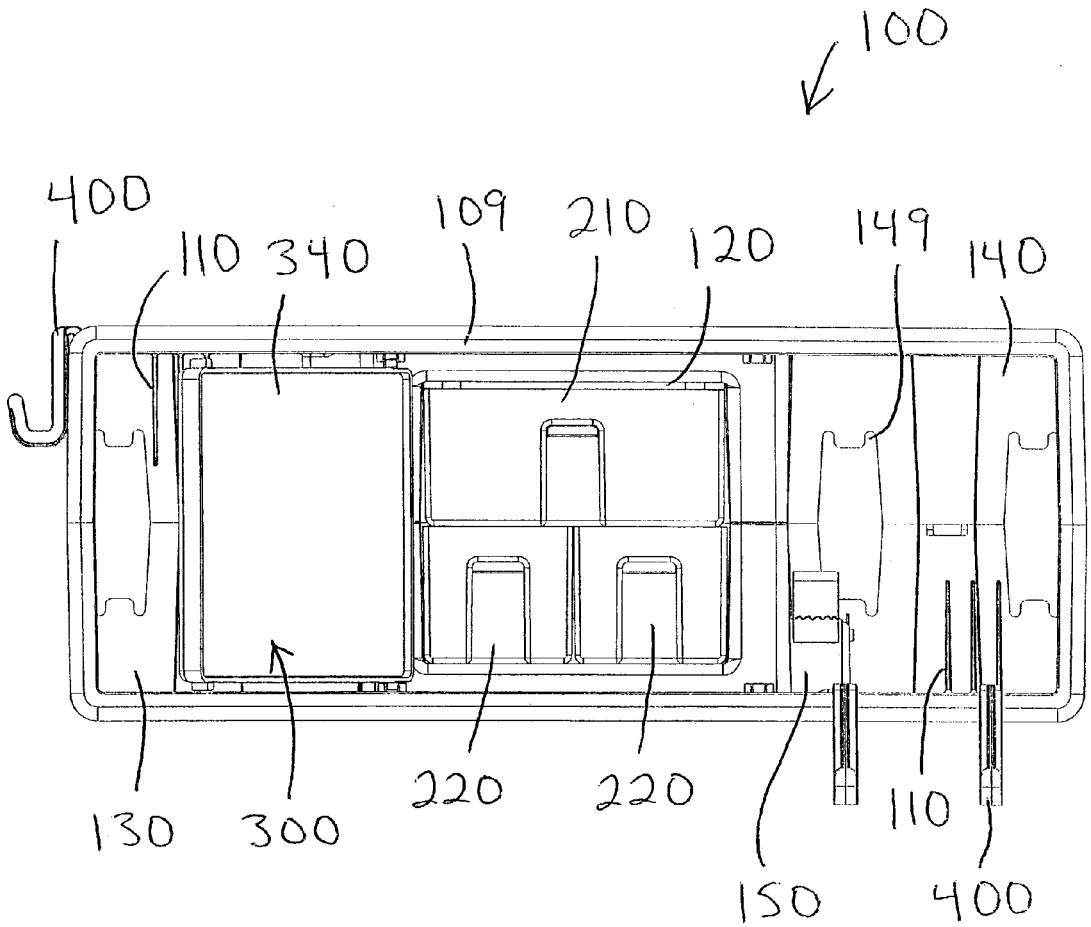
FIG. 7 is a front view of the storage device of FIG. 3.

As shown in FIG. 7, the box 100 defines three forwardly opening compartments, including a middle compartment 120, and left and right side compartments 130 and 140, respectively. The left side compartment 130 may be described as an upside-down version of the right side compartment 140.

Each side compartment 130 and 140 includes an integral tape roll dispenser 150 (the left side dispenser is upside-down relative to the right side dispenser). Each dispenser 150 includes opposing sidewalls that are slotted to receive opposite ends of a tape supporting hub, and the closed ends of the slots define a fixed axis of rotation for the conventional tape roll 95. Each dispenser 150 also includes a forward edge that is configured to support a distal end of the tape and to provide a cutting edge for the tape.

Each side compartment 130 and 140 also includes integral vertical dividers 110 that define adjacent compartments for receiving and storing items such as envelopes or compact discs. The dividers 110 preferably extend into both the rear wall and the top or bottom wall of the box 100 (depending on the compartment 130 or 140 or the orientation of the box 100). The side with the downwardly extending dividers 110 allows a person to choose whether to use the dividers to sort relative tall and thin items, or to use the underlying space for relatively bulkier items, such a stapler.

Each side compartment 130 and 140 also includes an end pocket wall 111 that cooperates with a respective end wall, as well as adjacent columns, to define an upwardly opening pocket suitable for receiving and storing items such as credit cards. The wall 111 preferably extends into the top or bottom wall of the box 100 (depending on the compartment 130 or 140 or the orientation of the box 100), and a bottom portion of the wall 111 preferably integrates into the adjacent columns, as well.

Figure 3:
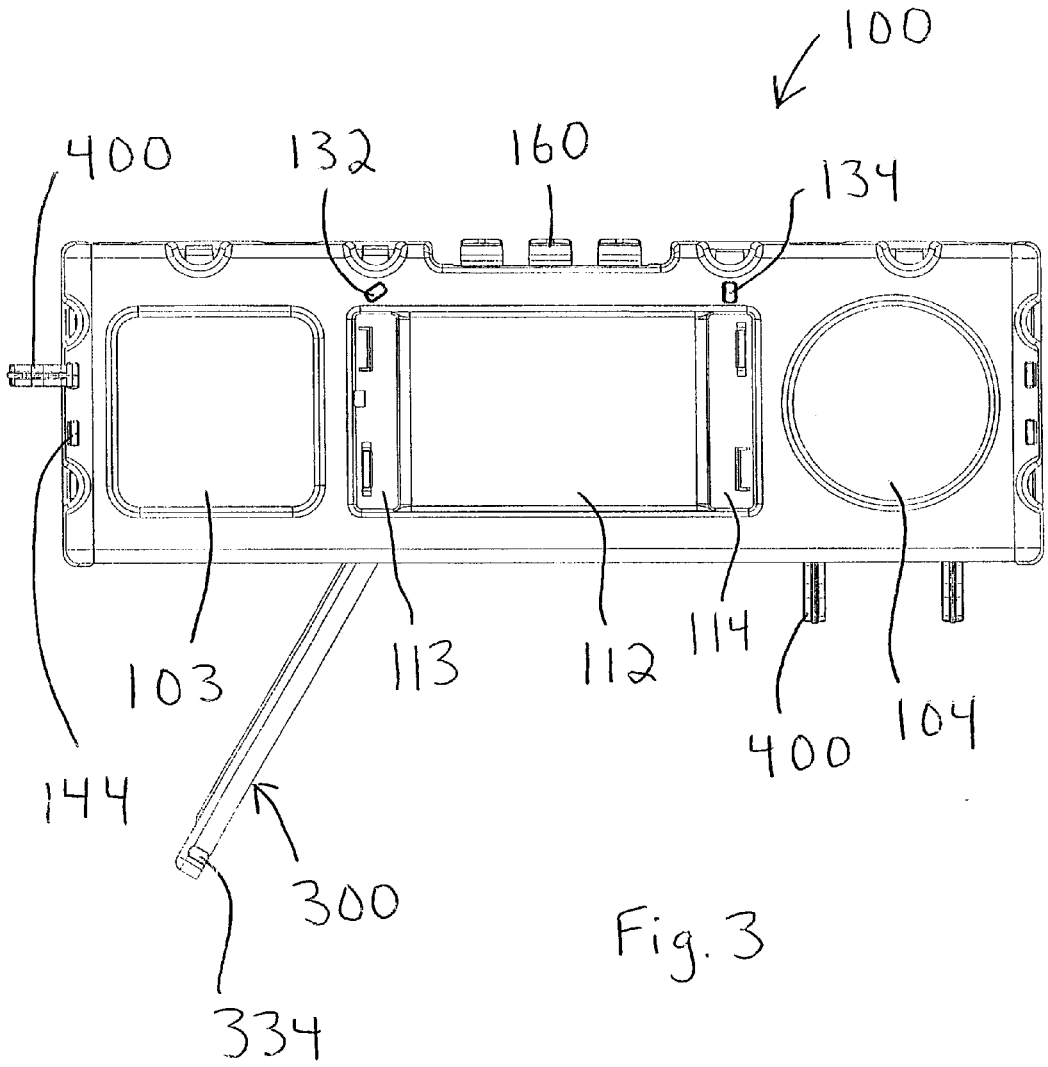
FIG. 3 is a top view of the storage device of FIG. 1, but arranged in an alternative, second configuration.
Figure 4:
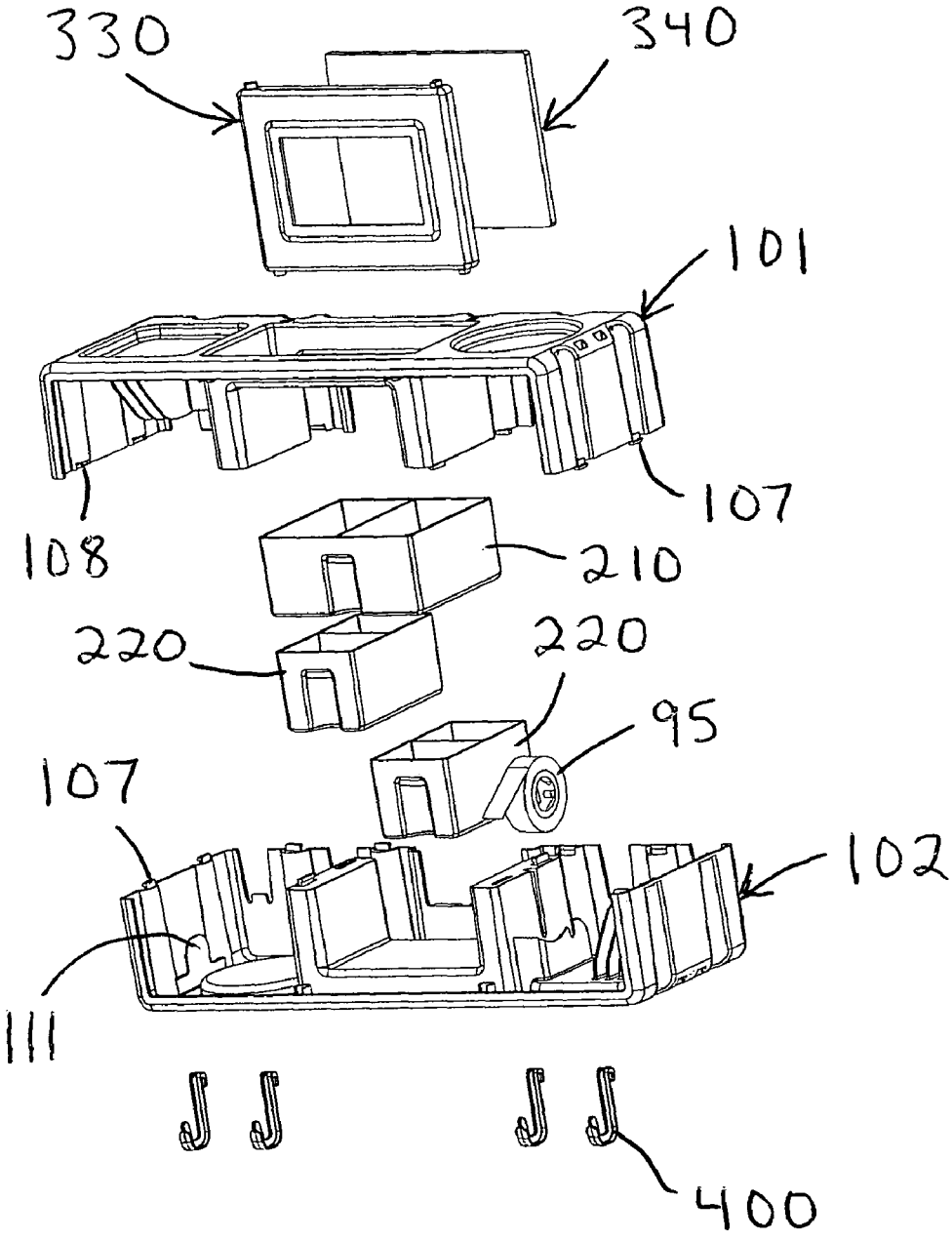
FIG. 4 is an exploded perspective view of the storage device of FIG. 1.

As shown in FIG. 3, a square recess or upwardly opening cavity 103 is formed in the top wall at a location overlying the left compartment 130. The square recess 103 is preferably sized and configured to receive and store a 3-inch by 3-inch note pad. A circular recess or upwardly opening cavity 104 is formed in the top wall at a location overlying the right compartment 140. The circular recess 104 is preferably sized and configured to receive and store an object having a 3-inch diameter circular base, including a beverage container, for example.

Figure 2:
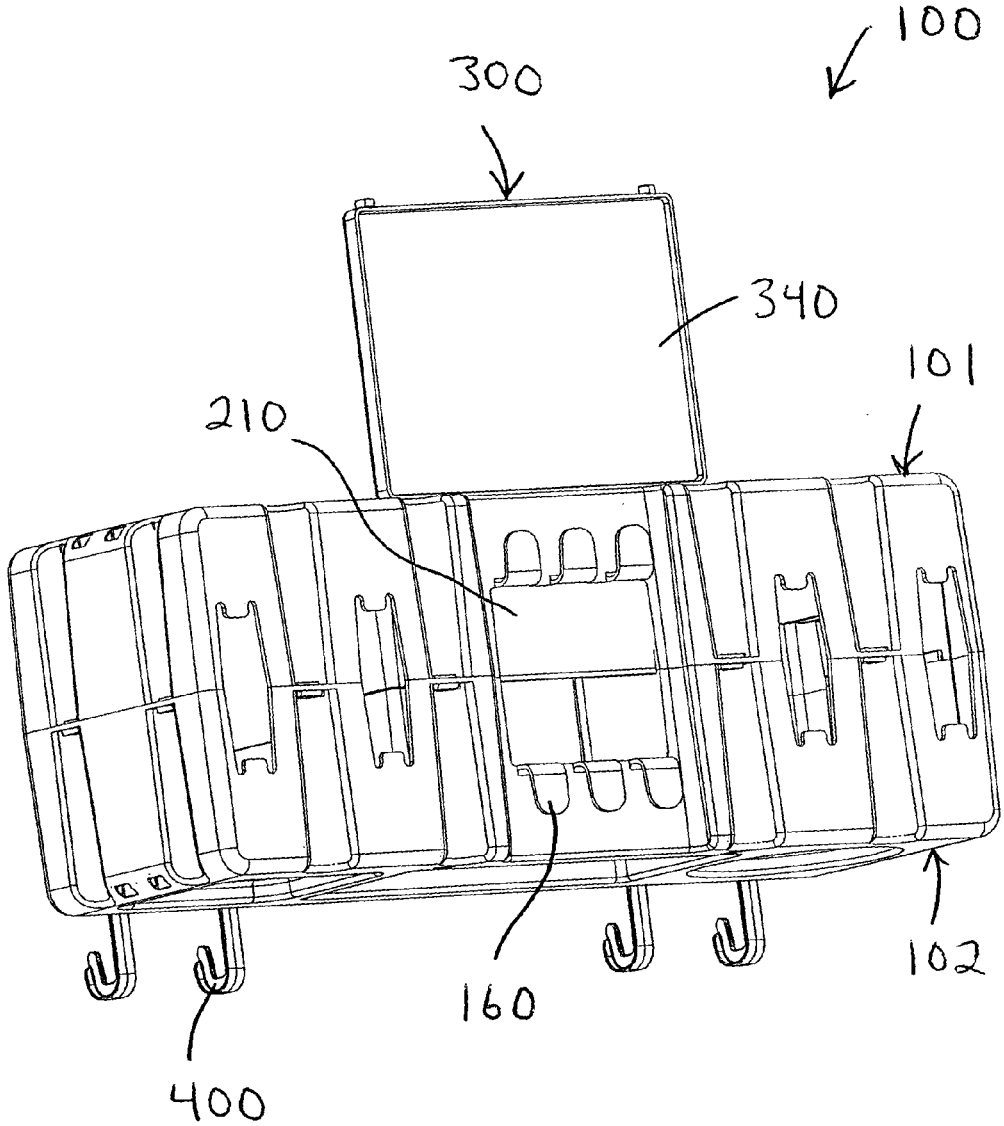
FIG. 2 is a second perspective view of the storage device of FIG. 1.

Openings are formed in portions of the rear wall that bound respective compartments 130 and 140. The openings define downwardly opening notches 149 that are sized and configured to fit onto screws that are threaded into a wall or other support structure. As shown in FIGS. 2 and 3, an intermediate portion of the rear wall is recessed to accommodate opposing pairs of cleats or hooks 160. The cleats 160 are configured and arranged to receive and store loops of cords for electronic devices, such as cell phone chargers or music players.

As shown in FIG. 7, the central compartment 120 is sized and configured to receive the three drawers 210 and 220 with just enough clearance or tolerance to accommodate unencumbered sliding of the drawers 210 and 220 into and out of the central or drawer compartment 120. The two lower drawers 220 are one-half as wide as the upper drawer 210. The arrangement is such that any one of the drawers 210 and 220 may be removed from the box 100 without disrupting the remaining drawers. In other words, the upper drawer 210 will remain supported on either drawer 220 in the absence of the other drawer 220, due to its confinement within the walls of the drawer compartment 120. Each drawer 210 and 220 defines at least one upwardly opening compartment to receive appropriately sized items for storage therein.

As shown in FIG. 3, a rectangular recess or upwardly opening cavity 112 is formed in the top wall of the upper box section 101 at a location overlying the middle compartment 120. The rectangular recess 112 is bounded by left and right end pockets 113 and 114, respectively, which are relatively deeper to receive and store items in a vertical orientation. Also, the end pockets 113 and 114 are bounded by walls that enhance both the interconnectedness of the upper box section 101 and lower box section 102, and the overall structural integrity of the box. The corresponding recess 112 in the lower box section 102 supports the drawers 220 at a sufficiently high elevation to clear the front lip 109 and relatively small items, such as pens, stored in the area rearward the front lip 109 and forward of the recess 112.

Figure 6:
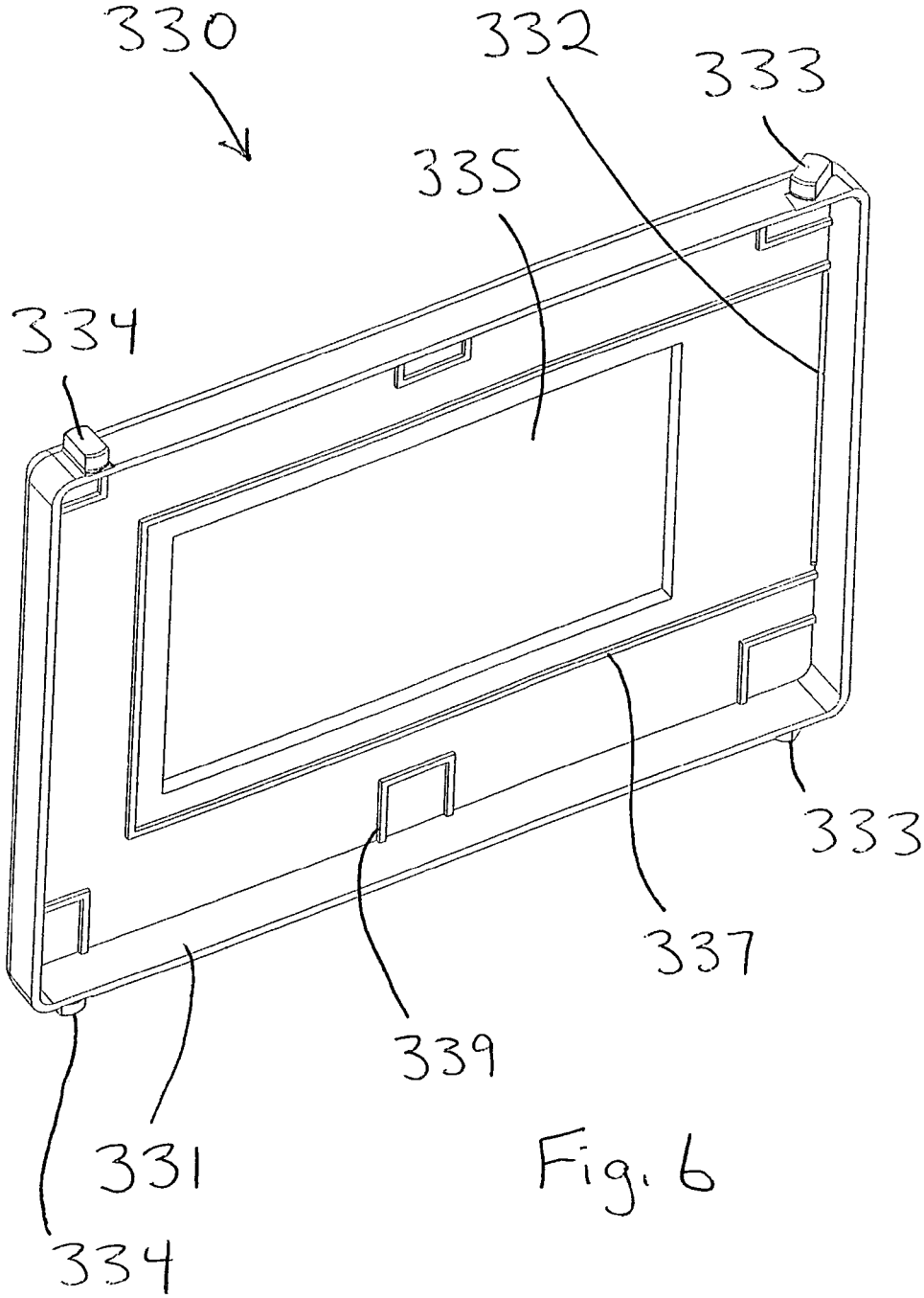
FIG. 6 is a perspective view of a panel on the storage device of claim 1.

As shown in FIG. 6, the frame member 330 is an injection molded plastic part that defines a central opening 335 sized to frame a 3-inch by 5-inch photograph. Ribs 337 on a back face of the frame member 330 form a C-shaped track or channel to receive and support the photograph in a centered position relative to the opening 335. Also, ribs 339 on the back face of the frame member 330 form offsets and pockets at intervals about the perimeter of the frame member 330. A peripheral flange 331 extends rearward from the edges of the front face of the frame member 330, thereby defining a cavity to receive the board 340.

The board 340 is preferably secured to the frame member 330 by adhesive, thereby defining the panel or door 300. The adhesive may be disposed in the pockets defined by the ribs 339, for example. One side of the board 340 spans the opening 335 and provides backing for a photograph to be viewed through the opening 335. An erasable writing surface is preferably disposed on an opposite side of the board 340. A slot 332 extends through the face of the frame member 330 and aligns with the ribs 337 to accommodate insertion and removal of photographs between the frame member 330 and the board 340. In other words, the photograph faces through the opening 335 in the frame member 330, and the erasable writing surface faces in an opposite direction. On the preferred embodiment 100, the board 340 is provided with a white, dry-erase surface of a type known in the art.

FIGS. 3 and 7 show the resulting panel or door 300 rotatably mounted to the upper and lower box sections 101 and 102. When so arranged, the panel 300 may be pivoted from an open position, as shown in FIGS. 3 and 7, to a closed position which hides or blocks access to the middle compartment 120 (and the drawers 210 and 220). In FIGS. 3 and 7, the photograph faces forward when the panel 300 is closed, but as further described below, the panel 300 can alternatively be arranged so the erasable writing surface faces forward when the panel 300 occupies a closed position relative to the middle compartment 120.

Figure 5:
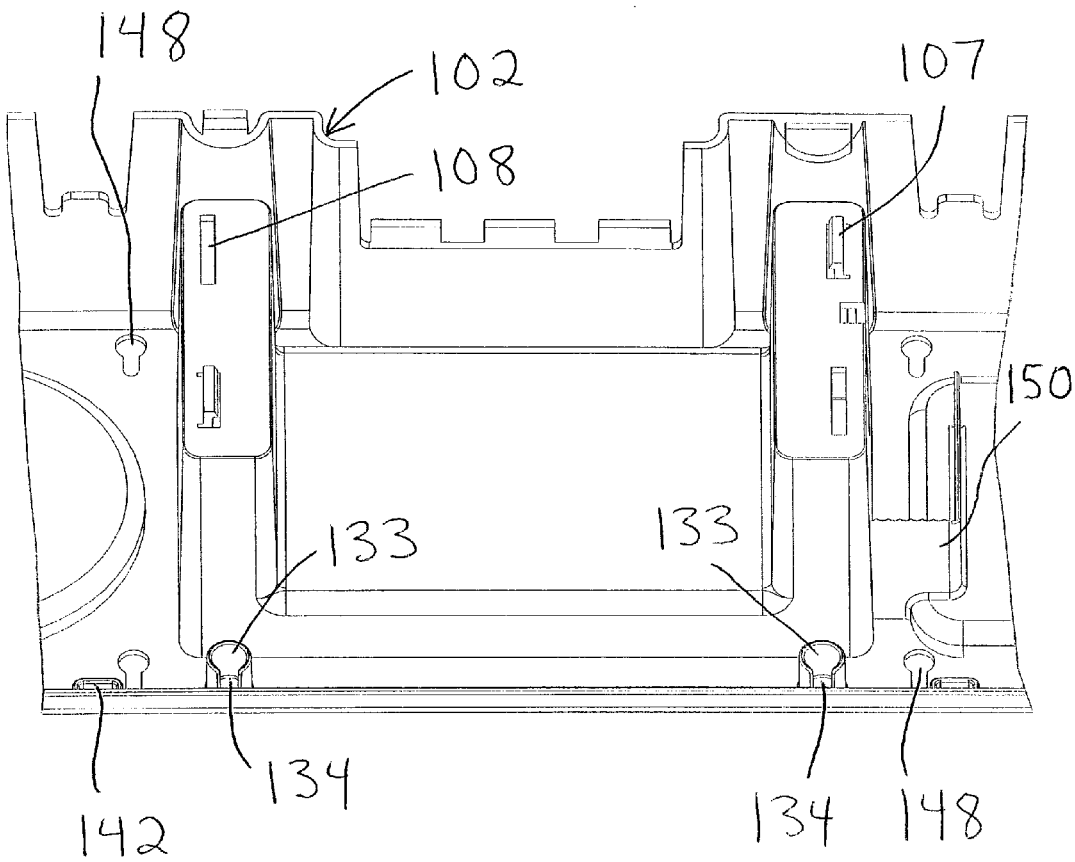
FIG. 5 is a fragmented perspective view of a bottom half of the storage device of claim 1.

FIG. 5 shows cylindrical sockets 133 disposed on the bottom wall of the lower box section 102 to receive and retain the panel 300. Each socket 133 is upwardly open-ended, and is accessible from the front via a slot 134. The two sockets 133 are equidistant from the midpoint of the box 100, so the sockets 133 on the lower box section 102 align vertically with similar sockets on the upper box section 101.

FIG. 6 shows first and second pegs 333 and 334 on the top and the bottom of the frame member 330. Each peg 333 and 334 may be described as a cylinder that has been cut lengthwise by two parallel and diametrically opposed planes, thereby configuring each peg 333 and 334 for rotation within any of the sockets 133, and for zero clearance passage through a slot 134 when properly oriented relative thereto. The top and bottom pegs 333 share a common orientation, and the top and bottom pegs 334 share a common orientation. When the panel 300 is arranged as shown in FIG. 3 and rotated to a closed position, the pegs 333 are configured and oriented to rotatably connect the panel 300 to the sockets 133, and the pegs 334 are configured and oriented for snap-fit passage through the slots 134. From this closed position, the panel 300 is rotatable ninety degrees to an open position to allow access to the middle compartment 120. When the panel 300 occupies this open position, the drawers 210 and/or 220 are visible and may be removed from the middle compartment 120, the writing surface on the board 340 is visible and may be read and/or written upon. In this orientation, the pegs 333 continue to rotatably connect the panel 300 to the sockets 133.

As shown in FIGS. 3 and 7, the panel 300 is rotatable another thirty degrees to a release position. In this orientation, the pegs 333 are configured and oriented for snap-fit passage through the slots 134, thereby allowing the panel 300 to be removed from the box sections 101 and 102. In other words, the panel 300 may be removed temporarily or permanently at the discretion of the user. As shown in FIG. 3, sockets 132 and 134 are provided on the top of the upper box section 101 to receive the pegs 333 and 334 on the frame member 330. As shown in FIGS. 1 and 2, this arrangement allows the panel 300 to be alternatively secured in place on top of the upper box section 101. By selectively flipping the panel 300 top over bottom, either the photograph or the erasable writing surface may be arranged to face forward. The panel 300 may be similarly flipped prior to installation in the sockets 133 to arrange either the photograph or the writing surface to face forward when the panel 300 is closed relative to the middle compartment 120. Moreover, the panel 300 may be flipped left to right or vice versa to place the hinge side of the panel 300 (associated with pegs 334) on either side of the middle compartment.

FIG. 5 also shows keyhole-shaped recesses 148 extending downward into the bottom wall on the lower box section 102. Similar recesses 148 extend upward into the top wall on the upper box section 101. The recesses or openings 148 provide guides for forming similarly shaped holes through the to wall of the upper box section 101, in order to mount the box 100 beneath a shelf or cabinet with screws or other suitable fasteners. In other words, the box 100 may be secured to the underside of a cabinet or shelf (via the openings 148), mounted on a wall (via the notches 149), or disposed on top of a horizontal work surface, such as a desktop. Also, the box 100 may be used in various operating modes, including hinged left with photograph facing forward; hinged left with writing surface facing forward; hinged right with photograph facing forward; hinged right with writing surface facing forward; on top with photograph facing forward; on top with writing surface facing forward; and separated from the box 100.

FIG. 5 also shows two of several upwardly opening sockets 142 positioned intermittently along the front edge of the lower box section 102. The generally S-shaped hooks 400 have first distal ends that are sized and configured to insert downward into any of the sockets 142, and opposite, second distal ends that are sized and configured to receive and support a key-ring. The hooks 400 are selectively removable from the box 100, and selectively repositionable along the front edge of the box 100. In instances when the box 100 is used as a desktop storage device, the hooks 400 must be removed to allow the box 100 to rest flat on a desktop, and may be inserted into similarly configured, upwardly opening sockets 144 formed in the upper outer ends of the box 100, as shown in FIG. 3. In instances when the box 100 is mounted on a wall or beneath a shelf or cabinet, the hooks 400 may be left in place at the discretion of the user.

Figure 8:
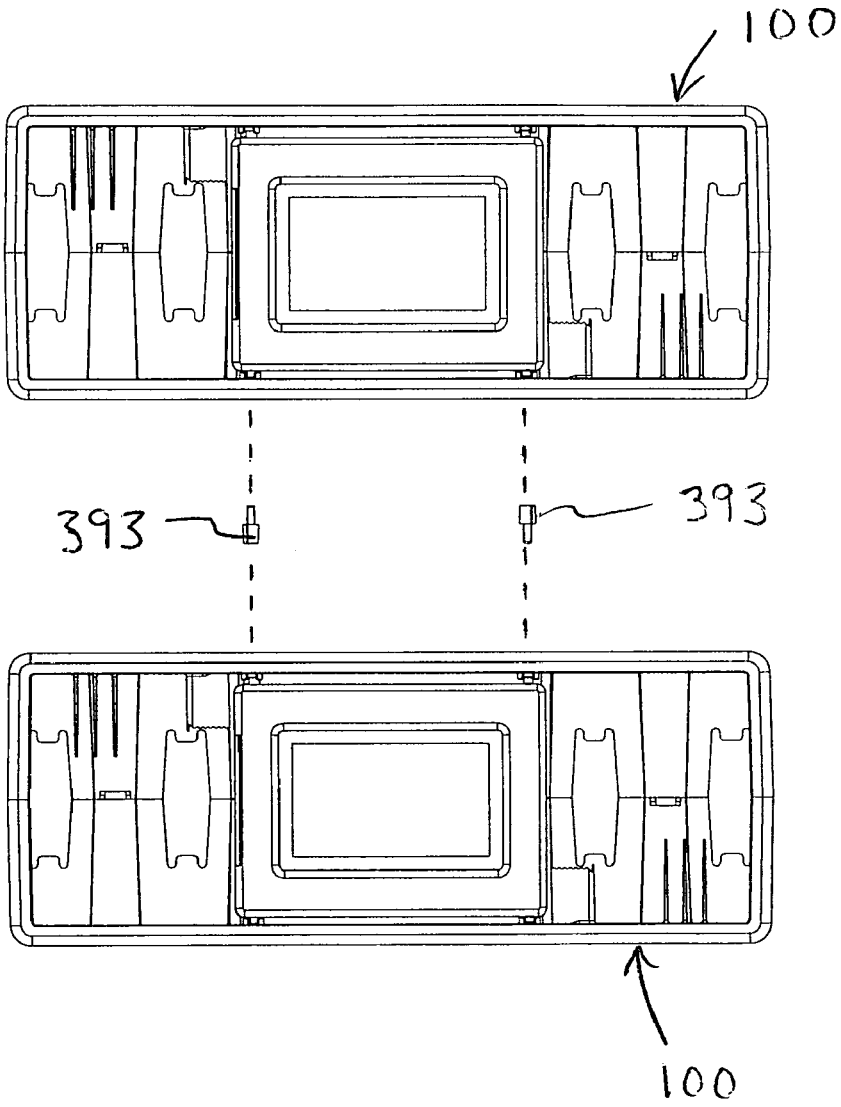
FIG. 8 is a front view of two of the storage devices of FIG. 3 arranged for vertical stacking one on top of the other.
Figure 9:
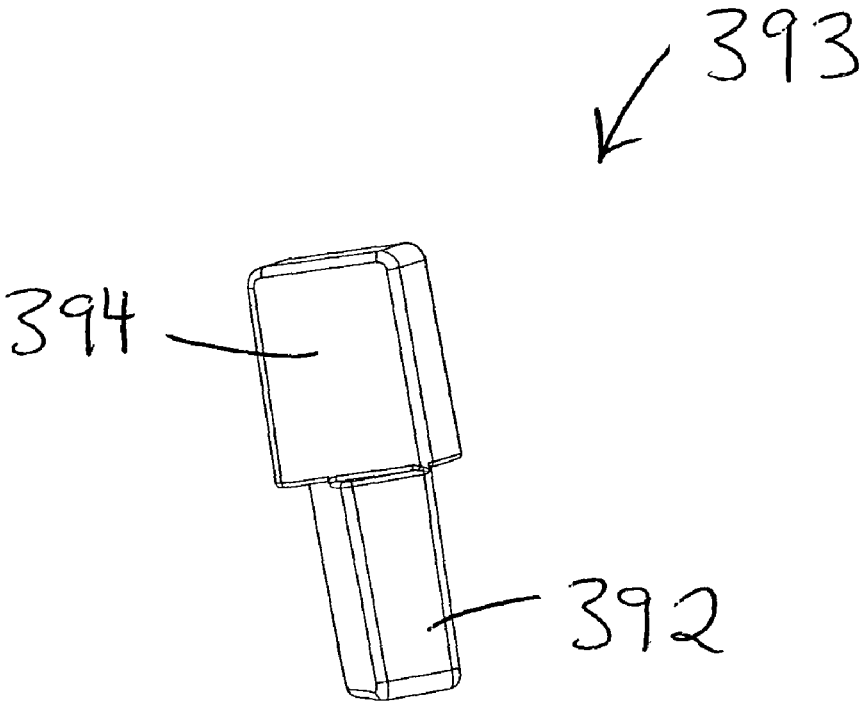
FIG. 9 is a perspective view of a peg that encourages the storage devices of FIG. 8 to remain stacked one on top of the other.

FIG. 8 shows how two of the boxes 100 may be vertically aligned and stacked or interconnected with fasteners or pegs 393. As shown in FIG. 9, each peg 393 includes a first end 392 that is configured and arranged for insertion into a socket 132, and a second end 392 that is configured and arranged for insertion into an aligned socket 134.

Figure 10:
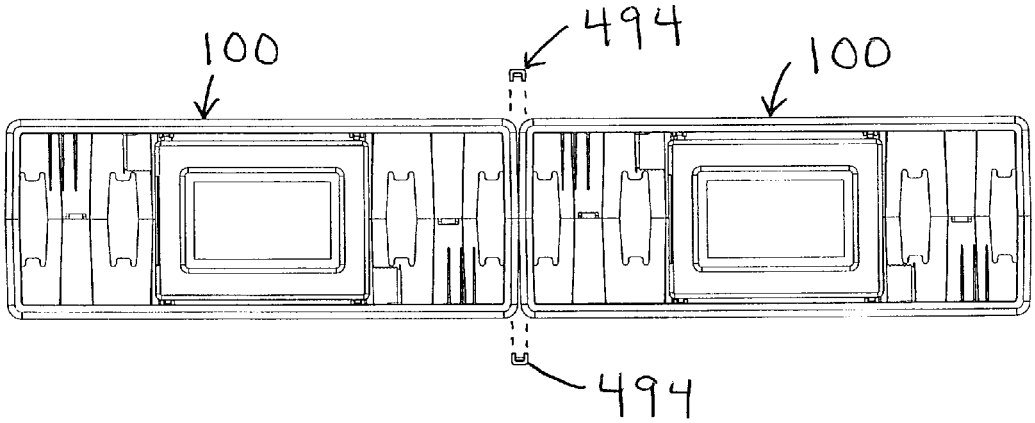
FIG. 10 is a front view of two of the storage devices of FIG. 3 arranged to horizontal stacking one beside the other.
Figure 11:
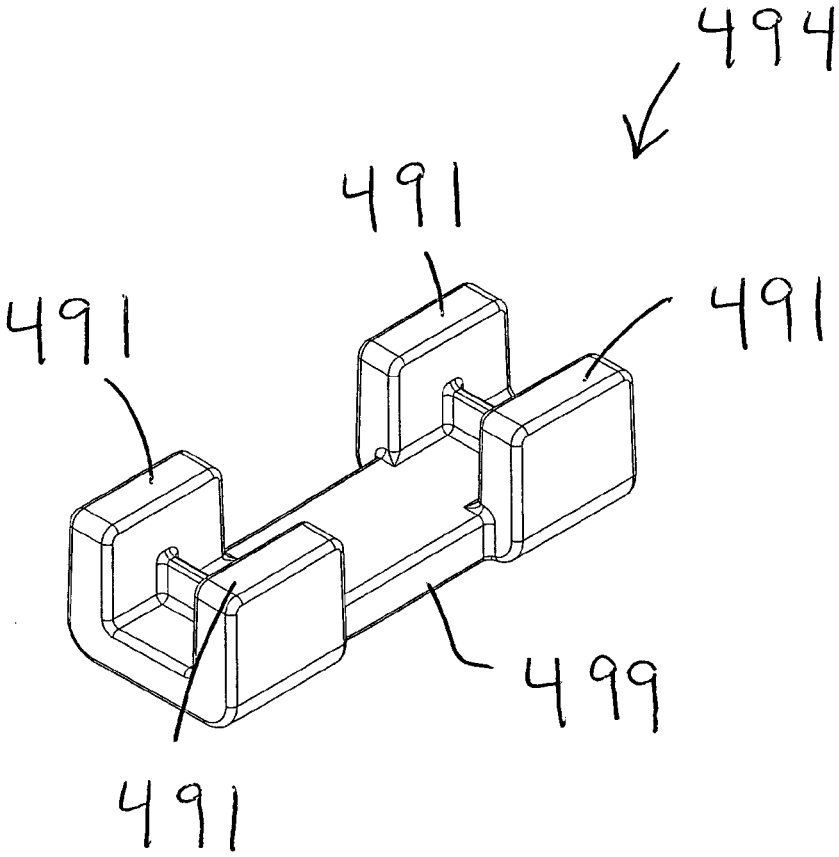
FIG. 11 is a perspective view of a clip that encourages the storage devices of FIG. 10 to remain stacked one beside the other.

FIG. 10 shows how two of the boxes 100 may be horizontally aligned and stacked or interconnected with fasteners or clips 494. As shown in FIG. 11, each clip includes a rectangular base 499 and four pegs 491 that project outward from respective corners of the base 499. The pegs 491 are configured and arranged for insertion into respective sockets 144 when the two boxes are arranged as shown in FIG. 10.

The foregoing description of the preferred embodiment will lead those skilled in the art to recognize additional configurations, embodiments, and/or applications which nonetheless incorporate the essence of the present invention. Among other things, less than all of the features of the present invention may be mixed and matched to arrive at other embodiments of the present invention. For example, an alternative embodiment storage box may be made with discrete upper and lower sections that incorporate other aspects of the present invention. As another example, two boxes may be stacked, and a first panel 300 may be mounted in the sockets 132 and 134 on the upper box, and a second panel 300 may be mounted in the sockets 133 on the lower box. In view of the many possibilities, the scope of the present invention is to be limited only to the extent of the following claims.

What is claimed is:

1. A storage device, comprising:

a box having a bottom wall, a top wall, a left sidewall, and a right sidewall, and defining a forwardly opening storage compartment, vertically aligned upper and lower sockets proximate a side of the forwardly opening storage compartment, and a discrete, upwardly opening storage compartment disposed outside the forwardly opening storage compartment, left of the right sidewall, and right of the left sidewall, wherein the upwardly opening storage compartment and the forwardly opening storage compartment open in perpendicular directions relative to one another;

a display panel having vertically aligned upper and lower pegs disposed in respective said sockets to rotatably mounted the display panel on the box for rotation about a vertical pivot axis between a first orientation, wherein the display panel blocks access to the forwardly opening storage compartment, and a second orientation, wherein the display panel allows access to the forwardly opening storage compartment; and at least one of a photograph and an erasable writing surface disposed on the display panel and facing forward when the display panel occupies the first orientation.

2. The storage device of claim 1, wherein the display panel is rotatable to a third orientation, wherein at least one of the pegs is removable from a respective one of the sockets, thereby accommodating selective removal of the display panel from the box.

3. The storage device of claim 2, wherein both the photograph and the erasable writing surface are disposed on the display panel, and the erasable writing surface is arranged to face rearward when the photograph faces forward, and the pegs are alternatively disposed in opposite said sockets to reverse which directions the photograph and the erasable writing surface are facing when the display panel occupies the first orientation.

4. The storage device of claim 2, wherein the display panel is alternatively mounted in a fixed orientation on top of the box, with said at least one of the pegs inserted into an upwardly opening socket on top of the box, rearward of the upwardly opening storage compartment, and the at least one of a photograph and an erasable writing surface facing forward.

5. The storage device of claim 1, wherein the box defines an adjacent, second forwardly opening compartment that is accessible when the display panel occupies the first orientation, and inaccessible when the display panel occupies the second orientation.

6. The storage device of claim 1, wherein the box defines a second set of vertically aligned upper and lower sockets proximate an opposite side of the forwardly opening storage compartment, and the pegs are alternatively disposed in respective ones of said second set of vertically aligned upper and lower sockets to rotatably mount the display panel on the box for rotation about an alternative vertical pivot axis.

7. The storage device of claim 1, wherein the upwardly opening storage compartment is a pencil tray configured and arranged to receive and retain a pencil at a location forward of the forwardly opening storage compartment and beneath a lower edge of the forwardly opening storage compartment.

8. The storage device of claim 1, wherein the upwardly opening storage compartment is a downwardly extending recess in the top wall of the box.

9. A storage device, comprising:

a box defining (a) an interior that is horizontally accessible through an open-ended front side of the box, (b) at least one upwardly opening first socket proximate a lower forward edge of the box, and (c) at least one upwardly opening second socket proximate a top side of the box;

a display panel having a display bearing side, and at least one downwardly extending peg configured and arranged for insertion into the at least one upwardly opening first socket to retain the display bearing side in a vertically upright, forwardly facing orientation directly in front of the interior, and alternatively, for insertion into the at least one upwardly opening second socket to retain the display bearing side in a vertically upright, forwardly facing orientation on top of the box.

10. The storage device of claim 9, wherein the at least one upwardly opening second socket is disposed proximate an upper rearward edge of the box.

11. The storage device of claim 10, wherein the box has a top wall that defines an upwardly opening storage compartment forward of the at least one upwardly opening second socket.

12. The storage device of claim 9, wherein the at least one upwardly opening first socket includes two upwardly opening first sockets spaced a distance apart from one another proximate respective, opposite sides of the interior, and the at least one upwardly opening second socket includes two upwardly opening second sockets spaced said distance apart from one another, and the at least one downwardly extending peg includes two pegs spaced said distance apart from one another.

13. The storage device of claim 12, wherein when said pegs occupy respective said first sockets, the display panel is rotatable about a pivot axis defined by one of said pegs and a respective one of said sockets, and when said pegs occupy respective said second sockets, the display panel is retained in a fixed orientation.

14. The storage device of claim 12, wherein the box defines two downwardly opening sockets proximate an upper forward edge of the box and in vertical alignment with respective said upwardly opening first sockets, and the display panel has two upwardly extending pegs in vertical alignment with respective said downwardly extending pegs, and the upwardly extending pegs are configured and arranged for insertion into respective said downwardly opening sockets, and all said pegs occupy respective said sockets when the display bearing side occupies said vertically upright, forwardly facing orientation directly in front of the interior.

15. A storage device, comprising:

a box defining a storage compartment having an open-ended front side, a downwardly opening socket having a cylindrical sidewall, and an upwardly opening socket having a cylindrical sidewall and vertically aligned with the downwardly opening socket proximate a side of the storage compartment, wherein at least one said sidewall is interrupted by an open-ended slot; and a display panel having a display bearing side, an upwardly extending peg, and a downwardly extending peg vertically aligned with the upwardly extending peg, wherein each said peg is configured and arranged to occupy a respective said socket to rotatably mount the display panel on the box for rotation about a vertical pivot axis between (a) a first orientation, wherein the display panel extends across the front side of the storage compartment with the display bearing side facing forward, (b) a second orientation, wherein the display panel allows access to the storage compartment, and (c) a third orientation, wherein at least one said peg is oriented to slide through a respective said slot in a respective said cylindrical sidewall, thereby facilitating selective removal of the display panel from the box.

16. The storage device of claim 15, wherein (a) the at least one said peg has an axially extending profile that is bounded by two diametrically opposed flat sides and two diametrically opposed arcuate sides, and (b) a slot width defined by the respective said slot is at least as great as a distance defined between the flat sides, and less than a diameter defined between the arcuate sides.

17. The storage device of claim 15, wherein a portion of the display panel interferes with a portion of the box to discourage rotation of the display panel into and out of the first orientation, and the display panel is movable vertically upward to establish clearance for said portion of the display panel to rotate past said portion of the box to accommodate rotation of the display panel into and out of the first orientation.

18. The storage device of claim 15, wherein the box defines a second said downwardly opening socket, and a second said upwardly opening socket vertically aligned with the second said downwardly opening socket, and each said upwardly opening socket is disposed proximate a respective side of the storage compartment, and a respective said slot interrupts the cylindrical sidewall of each said upwardly opening socket.

19. The storage device of claim 18, wherein each said peg is configured and arranged to alternatively occupy a respective second said socket to rotatably mount the display panel on the box for rotation about a discrete vertical pivot axis between the first orientation, wherein the display panel extends across the front side of the storage compartment, and a third orientation, wherein the display panel allows access to the storage compartment.

20. The storage device of claim 18, wherein the display panel has a second said upwardly extending peg, and a second said downwardly extending peg vertically aligned with the second said upwardly extending peg, wherein each said second peg is configured and arranged to occupy a respective said socket on either side of the box.

21. The storage device of claim 20, wherein the display panel has a first display bearing side that faces forward when the display panel is arranged in the first orientation with said second downwardly extending peg occupying said second upwardly opening socket, and an opposite facing, second display bearing side that alternatively faces forward when the display panel is arranged in the first orientation with said second downwardly extending peg occupying said second downwardly opening socket.

22. The storage device of claim 18, wherein the display panel has a first display bearing side and an opposite facing, second display bearing side, and the display panel is alternatively flipped one hundred eighty degrees top over bottom, and the pegs are inserted in opposite said sockets to reverse which said display bearing side faces forward when the display panel occupies the first orientation.

23. The storage device of claim 18, wherein the box defines at least one upwardly opening top socket proximate a top portion of the box, and the top socket is configured and arranged to receive the downwardly opening peg to retain the display panel in a vertical orientation on top of the box with the display bearing side facing forward.

* * * * *